US006200238B1

(12) United States Patent
Tackett

(10) Patent No.: US 6,200,238 B1
(45) Date of Patent: Mar. 13, 2001

(54) ROLLER HOCKEY PUCK

(76) Inventor: Edward C. Tackett, 6234 Lake Alamor Ave., San Diego, CA (US) 92101

( * ) Notice: Subject to any disclaimer, the term of this patent is extended or adjusted under 35 U.S.C. 154(b) by 0 days.

(21) Appl. No.: 09/418,420

(22) Filed: Oct. 18, 1999

(51) Int. Cl.[7] ..... A63B 71/00
(52) U.S. Cl. ..... 473/588; 473/588
(58) Field of Search ..... 473/588, 589, 473/FOR 229, FOR 230, FOR 231

(56) References Cited

U.S. PATENT DOCUMENTS

| | | | | |
|---|---|---|---|---|
| 5,269,520 | * | 12/1993 | Vellines | 473/588 |
| 5,275,410 | * | 1/1994 | Bellehumeur et al. | 473/588 |
| 5,482,274 | | 1/1996 | Bellehumeur . | |
| 5,518,237 | * | 5/1996 | Bellehumeur | 473/588 |
| 5,568,923 | | 10/1996 | Kahn et al. . | |
| 5,597,161 | * | 1/1997 | Bellehumeur et al. | 473/588 |
| 5,695,420 | * | 12/1997 | Bellehumeur | 473/588 |
| 5,697,858 | * | 12/1997 | Lekavich | 473/588 |
| 5,707,308 | * | 1/1998 | Liu | 473/588 |
| 5,733,213 | | 3/1998 | Colarusso . | |
| 5,816,965 | * | 10/1998 | Kotler | 473/588 |
| 5,976,042 | * | 11/1999 | LaMarche et al. | 473/588 |
| 6,010,418 | * | 1/2000 | Lekavich | 473/588 |

* cited by examiner

*Primary Examiner*—Raleigh W. Chiu
(74) *Attorney, Agent, or Firm*—Harrison & Egbert

(57) ABSTRACT

A roller hockey puck having an outer shell of annular configuration, a central core positioned centrally interiorly of the outer shell, and a transition section extending from the central core to the outer shell. The transition section has a plurality of elliptical holes formed therein. The transition section has a top surface formed inwardly of a top planar surface of the outer shell. The transition section has a bottom surface formed inwardly of the bottom planar surface of the outer shell. The plurality of elliptical holes are uniformly spaced around the central core. The central core has a truncated spherical configuration with central axis aligned with a central axis of the outer shell. A plurality of runners are respectively received by a plurality of through bores formed in the outer shell. Each of the plurality of runners has a top surface extending outwardly of the outer shell. The outer shell, the central core and the transition section are integrally formed together of high density polyethylene material adapted to maintain a constant durometer between 30 degrees and 150 degrees Fahrenheit.

18 Claims, 2 Drawing Sheets

ROLLER HOCKEY PUCK

TECHNICAL FIELD

The present invention relates to games involving projectiles. More particularly, the present invention relates to hockey pucks. More particularly, the present invention relates to roller hockey pucks which are used in roller hockey games.

BACKGROUND ART

The sport of roller hockey has exploded in the recent past. Because of this tremendous expansion of the sport, the business of providing equipment has also exhibited dramatic growth. While the transition from conventional ice hockey equipment was quick to occur for skates (from ice skates to in-line roller skates) and hockey sticks (roller hockey sticks have blades made of durable plastic material rather than wood), the transition from an ice hockey puck to a puck suitable for playing roller hockey has been more difficult. This is due to the tremendous difference between the high coefficient of friction of a paved surface on which roller hockey is generally played and the lower coefficient of friction of an ice-covered surface.

In the sport of roller hockey, roller hockey teams try to put the roller hockey puck into the opposing player's net. This is accomplished by striking the roller hockey puck with a curved stick. The motion of impact sends the puck in the desired direction. The geometry of the puck plays a key role in the direction, speed and accuracy of the shot. Unlike ice hockey pucks, the roller hockey puck has several distinct disadvantages compared to an ice hockey puck. Rather, it does not slide easily over the multitude of roller hockey playing surfaces. This is due to the friction generated by the roller hockey puck as it slides along the surface and the unevenness of current playing fields. Another drawback to current roller hockey pucks designs is that no consideration was given to the aerodynamic properties or flight characteristics. Additionally, when a roller hockey puck strikes the protective board system, the roller hockey puck tends to rebound in unpredictable trajectories. The sport of roller hockey has technologically progressed and the players demand better equipment as the level of game play increases.

As might be expected, the art is replete with potential solutions to these problems. There are a wide variety of different design changes that have been proposed to provide a puck which glides more smoothly over paved surfaces. The art is focused on four different approaches to providing a roller hockey puck capable of gliding more smoothly over a paved surface. These four approaches are: (1) the use of a material having a lower coefficient of friction; (2) the use of spherical rollers or balls extending above the opposing faces of the puck; (3) the use of small "runners" which extend above the opposing spaces of the puck, the runners being made of material having a low coefficient of friction; and (4) the use of larger area surfaces located on the opposing faces of the puck.

In the past, various patents have issued with respect to roller hockey pucks. For example, U.S. Pat. No. 5,482,274, issued on Jan. 9, 1996, to A. R. Bellehumeur, describes a roller hockey puck having recessed runners. This roller hockey puck has at least three runners extending above and below its upper and lower faces. The runners have a head which is retained partially in the recess of the puck. The recess supports the head and reduces the tendency of it to break. The first set of runners extends above and below the upper and lower faces of the puck while a second set of runners is positioned closer to the upper and lower faces than the first runners.

U.S. Pat. No. 5,568,923, issued on Oct. 20, 1996, to Kahn et al., describes a roller hockey puck having a puck body of circular cylindrical configuration with a minimum of three multi-directional roller wheel assemblies which are mounted in symmetrical equiangular relationship around the puck center. Each wheel assembly includes a cylindrical wheel support body mounted for rotation on a central main axle parallel to the planar slide surfaces of the puck. Each wheel assembly includes at least one set of wheels journaled for rotation on its own individual axle mounted in a plane perpendicular to the main axle of the wheel assembly. The plurality of wheel assemblies allow a rolling action of at least one of the wheels whenever a force is applied to the puck with a force component parallel to the plane of the playing surface.

U.S. Pat. No. 5,733,213, issued on Mar. 31, 1998, to M. Colarusso, describes a roller hockey puck which exhibits minimized coefficients of friction and is able to more freely roll on an irregular surface. This roller hockey puck includes a spherical roller which is supported by an array of bearings located in the puck body. The spherical roller extends slightly above the opposing faces of the puck body to minimize friction as the roller hockey puck glides on a paved surface. Annular arrays of runners are located on and extend out from each of the opposing faces of the roller hockey puck to stabilize the roller hockey puck as it glides on the paved surface.

It is an object of the present invention to provide a superior roller hockey puck for playing the sport of roller hockey on a wide variety of playing surfaces.

It is another object of the present invention to provide a lubricated low friction roller hockey puck of official ice hockey size and weight which incorporates a means to assist the roller hockey puck in maintaining stability regardless of trajectory.

It is another object of the present invention to provide a roller hockey puck which has improved aerodynamic flight characteristics.

It is still another object of the present invention to provide a roller hockey puck which is easy to use, relatively inexpensive and easy to manufacture.

These and other objects and advantages of the present invention will become apparent from a reading of the attached specification and appended claims.

SUMMARY OF THE INVENTION

The present invention is a roller hockey puck that comprises an outer shell of annular configuration having a having a top planar surface and a bottom planar surface, a central core positioned centrally and interiorly of the outer shell, and a transition section extending from the central core to the outer shell. The transition section has a plurality of elliptical holes formed therein.

In the present invention, the transition section has a top surface formed inwardly of the top planar surface of the outer shell. The transition section has a bottom surface formed inwardly of the bottom planar surface of the outer shell. The plurality of elliptical holes are uniformly spaced around the central core. Each of the plurality of elliptical holes has a centerline longitudinally therethrouugh. The centerline extends at an acute angle relative to a radius extending from a center point of the central core. The centerline extends on a line tangent to an outer surface of the central core.

The central core is a generally truncated sphere having a central axis aligned with a central axis of the outer shell. The central core has a top surface coplanar with the top planar surface of the outer shell. The central core has a bottom surface coplanar with the bottom planar surface of the outer shell.

In the present invention, the outer shell has a cylindrically-shaped outer surface. The outer shell has a plurality of through bores extending from the top planar surface to the bottom planar surface. The plurality of through bores are uniformly radially spaced from one another around the outer shell. A plurality of runners are respectively received by the plurality of through bores. Each of the plurality of runners has a top surface extending outwardly of the top planar surface. Each of the plurality of runners has a bottom surface extending outwardly of the bottom planar surface.

In the present invention, the outer shell, the central core and the transition section are formed of high density polyethylene material adapted to maintain a constant durometer between 30 degrees and 150 degrees Fahrenheit.

DETAILED DESCRIPTION OF THE INVENTION

Figure 1:
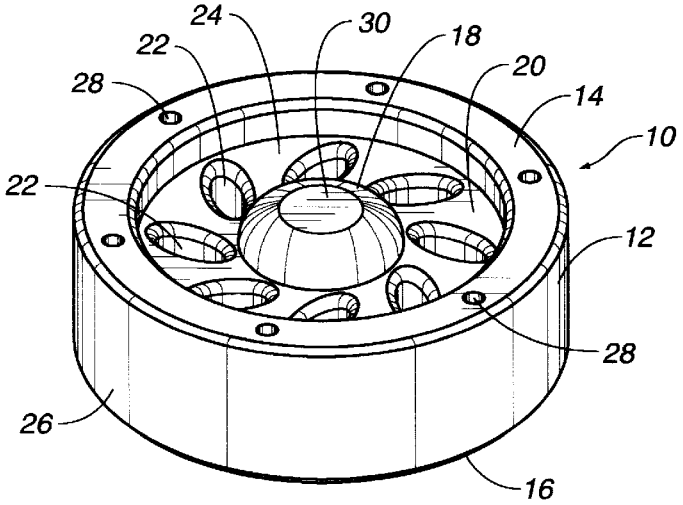
FIG. 1 is an upper perspective view of the roller hockey puck of the present invention with the runners omitted therefrom.

Referring to FIG. 1, there is shown the roller hockey puck 10 in accordance with the present invention. The illustration of the roller hockey puck 10 omits the runners for the purpose of clarity. The roller hockey puck 10 includes an outer shell 12 having a top planar surface 14 and a bottom planar surface 16. A central core 18 is positioned centrally and interiorly of the outer shell 12. A transition section 20 extends from the central core 18 to the outer shell 12. The transition section 20 has a plurality of elliptical holes 22 formed therein.

As can be seen in FIG. 1, the transition section 20 has a top surface 24 which is formed inwardly of the top planar surface 14 of the outer shell 12. In other words, the transition section 20 will be counter-sunk into the top planar surface 14 of the roller hockey puck 10. A similar construction will occur with respect to the bottom surface the transition section 20 relative to the bottom planar surface 16 of the outer shell 12.

In FIG. 1, it can be seen that the outer shell 12 has a generally cylindrically-shaped outer surface 26. Outer surface 26 provides the surface upon which the roller hockey puck 10 can be struck by a hockey stick. The outer surface 26 will have a generally similar size and configuration like that of an ice hockey puck. Through bores 28 will extend through the outer shell 12 from the top planar surface 14 to the bottom planar surface 16. Through bores 28 are evenly spaced around the outer shell 26. The through bores 28 will be of a size and shape suitable for receiving low-friction runners therein. The through bores 28 will extend through the outer shell 12 in a generally vertical orientation transverse to the plane of the top planar surface 14 or the bottom planar surface 16. The top planar surface 14 is in parallel relationship to the bottom planar surface 16.

The plurality of elliptical holes 22 are uniformly spaced around the central core 18. Each of the plurality of elliptical holes has a centerline which extends longitudinally therethrough. The centerline will be at an acute angle relative to a radius extending from the center point of the central core 18. As can be seen, each of the plurality of elliptical holes 22 has its centerline extending on a line tangent to the outer surface of the central core 18.

Central core 18 is a generally truncated sphere having a central axis forming the center of the roller hockey puck 10 and which is aligned with a central axis of the outer shell 12. The central core 18 has a top surface 30 which is coplanar with the top planar surface 14 of the outer shell 12. As will be described hereinafter, the central core 18 will have a bottom surface which is coplanar with the bottom planar surface 16 of the outer shell.

The outer shell 12, the central core 18 and the transition section 20 are formed of a high density polyethylene material adapted to maintain a constant durometer between 30 degrees and 150 degrees Fahrenheit.

Figure 2:
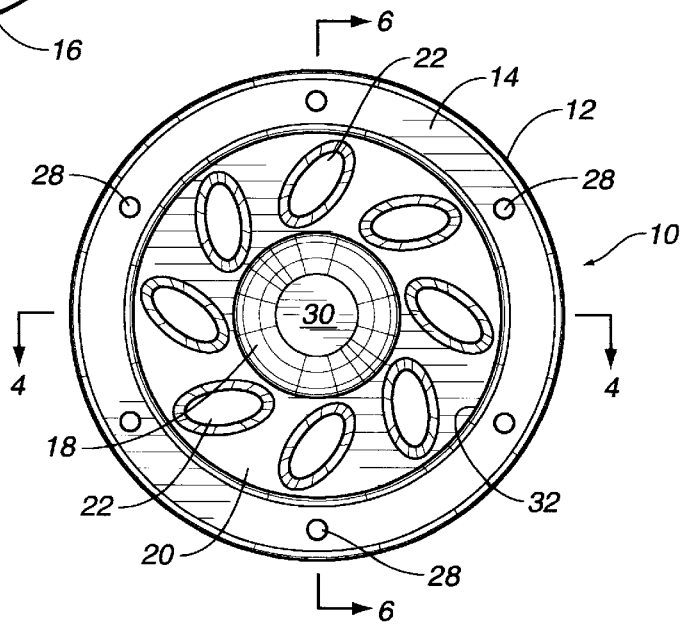
FIG. 2 is a plan view of the roller hockey puck of the present invention with the runners omitted therefrom.

FIG. 2 shows with particularity, the configuration of the present invention. As can be seen in FIG. 2, the outer shell 12 is of generally of annular configuration. The plurality of through bores 28 are positioned around the outer shell 12 in evenly spaced relationships. The central core 18 has a top surface 30 which is centrally positioned in the outer shell 12. The transition section 20 extends from the central core 18 to the inner wall 32 of the outer shell 12.

Figure 3:
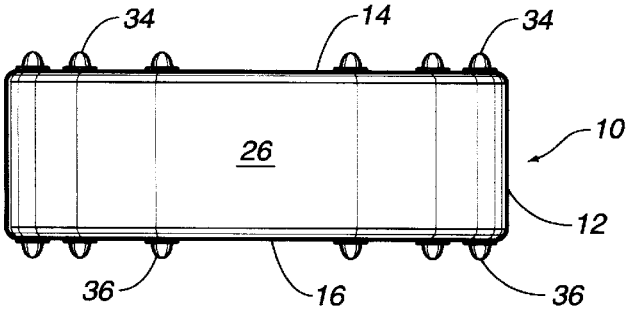
FIG. 3 is an end view of the roller hockey puck of the present invention.

In FIG. 3, the roller hockey puck 10 is particularly illustrated. The roller hockey puck 10 shows outer surface 26 of a generally cylindrically-shaped configuration. As can be seen in FIG. 3, a plurality of runners 34 extend outwardly of the top planar surface 14 of the outer shell 12. Similarly, a plurality of runners 36 extend outwardly beyond the bottom planar surface 16 of the outer shell 12. In normal use, the runners 34 and 36 are of a low-friction material so as to allow the roller hockey puck 10 to easily glide upon a surface. The small amount of contact area between the top of the respective runners 34 and 36 and the playing surface will allow for the low-friction gliding of the roller hockey puck 10. The runners 34 and 36 are received in respective through bores 28 on the outer shell 12.

Figure 4:
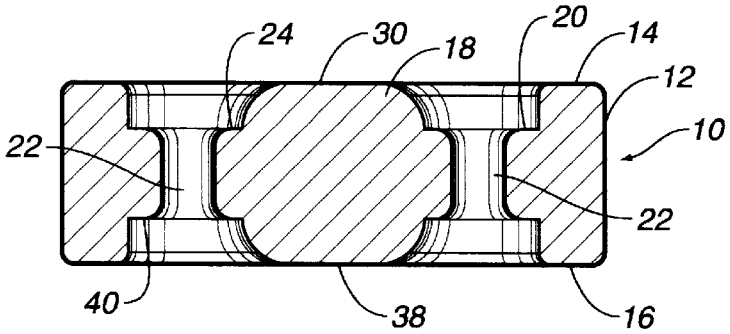
FIG. 4 is a cross-sectional view taken across lines 4—4 of FIG. 2.

FIG. 4 shows a cross-section view of the roller hockey puck 10 of the present invention. In particular, in FIG. 4, it can be seen how the central core 18 is in the shape of a truncated sphere. In FIG. 4, the roller hockey puck 10 has its outer shell 12 having a top planar surface 14 and a bottom planar surface 16. The central core 18 has its top surface 30 coplanar with the top planar surface 14. Similarly, the central core 18 is shown as having its bottom surface 38 coplanar with the bottom planar surface 16 of the outer shell 12.

In FIG. 4, the transition section 20 is illustrated as extending between the central core 18 and the outer shell 12. The transition section 20 has a top surface 24 which extends inwardly of the top planar surface 14 of the outer shell 12. Similarly, the transition section 20 has a bottom surface 40 extending inwardly from the bottom planar surface 16 of the outer shell 12. The respective elliptical holes 22 extend through the transition section 20 between the top surface 24 and the bottom surface 40.

Figure 5:
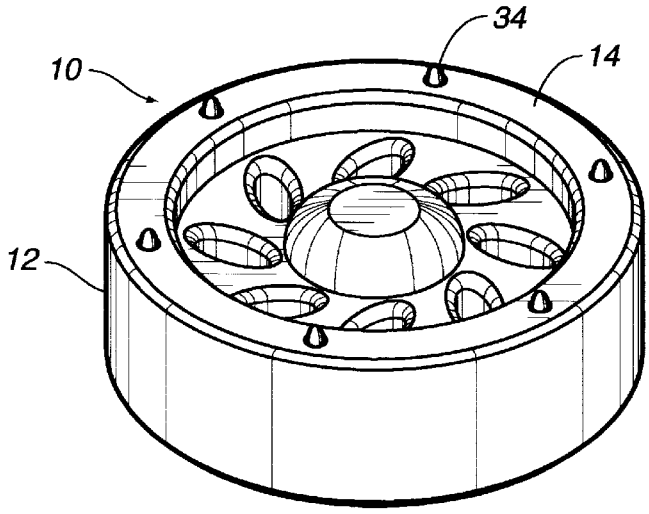
FIG. 5 is an upper perspective view of the present invention showing the attachment of runners.

FIG. 5 shows the roller hockey puck 10 in accordance with the preferred embodiment of the present invention. The roller hockey puck 10 is shown in FIG. 5 with the respective runners 34 extending outwardly from the respective through bores 28 on the outer shell 12. The runners 34 will extend outwardly from the top planar surface 14 for a desired distance so as to minimize frictional contact between the top planar surface 14 and the surface upon which the roller hockey puck 10 travels.

Figure 6:
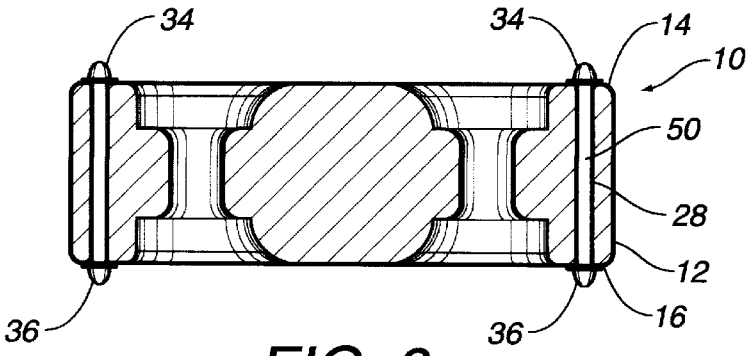
FIG. 6 is a cross-sectional view taken across lines 6—6 of FIG. 2.

FIG. 6 shows a cross-sectional view illustrating, in particular, how the respective runners 34 and 36 are secured within the through bores 28 formed in the outer shell 12. As can be seen in FIG. 6, the through bore 28 has one end opening at the top planar surface 14 and another end opening at the bottom planar surface 16 of the outer shell 12. The runner 34 is connected to a shaft 50 which extends through the through bore 28. Similarly, the runner 36 is connected to the shaft 50 which extends through the through bore 28. The runner 34 will emerge outwardly of the through bore 28 at the top planar surface 14. The runner 36 will emerge at the bottom planar surface 16. This arrangement is similar for each of the through bores 28 formed in the outer shell 12 of the roller hockey puck 10 of the present invention.

In the present invention, the central core, the transition section and the outer shell are constructed of a high density polyethylene material formulated with high and low temperature plasticizers and custom-blended high density polyethylene dye. The plasticizers maintain a constant durometer rating within the high density polyethylene between the temperatures of 30 and 150 degrees Fahrenheit. By maintaining a constant durometer, the roller hockey puck 10 of the present invention is provided with predictable playing characteristics. This will serve to eliminate bounce and instability due to heat transfer from the playing surface.

The elliptically-shaped central core 18 provides a center of gravity for the roller hockey puck 10. The mass characteristics of the central core 18 act as a focal point for any spin placed on the roller hockey puck 10 by the roller hockey player. This will provide stability in flight when the roller hockey puck 10 leaves the playing surface. The truncated sphere provides directional flow of air to the flight plane.

The elliptically-shaped holes on the transition section 20 provide passages for air to travel through. This neutralizes the pressures associated with air flow on a moving object. This phenomenon allows the roller hockey puck 10, once placed in motion, to maintain a predictable flight path that is true to the forces applied, regardless of the flight angle.

The roller hockey puck 10 of the present invention is generally the same size, weight and shape of an ice hockey puck. The roller hockey puck 10 is formed of a single piece of engineered high density polyethylene material and uses TEFLON(TM) impregnated ACETAL(TM) runners 34 and 36. The runners 34 and 36 are inserted into the outer shell 12 of the roller hockey puck 10 on the top planar surface 14 and the bottom planar surface 16 subsequent to the formation of the body of the roller hockey puck 10. Flight stability of the roller hockey puck 10 is maintained by air passing through the elliptical holes 22 on the transition section 12. Air flow direction is maintained by the truncated spherical central core 18, which directs rushing air through the aerodynamic flight plane of the transition section 20. The transition section 20 then passes the rushing air out of the opposite surfaces by utilizing elliptical holes 22 having little or no effect on artificial flight. This phenomenon is present regardless of the path and angle of flight. As the roller hockey puck 10 moves, the compression of atmospheric gases is maintained at a 1:1 ratio by the construction of the present invention. Therefore, the performance of the roller hockey puck 10 is consistent regardless of planar orientation.

The roller hockey puck 10 of the present invention provides for predictable impact response. This predictable impact response is through the combined use of the elliptical holes 22 on the transition section 12, the wall thickness of the outer shell 12 and the elliptically-shaped central core 18. The roller hockey puck 10 of the present invention will disperse the errant forces that cause unpredictability in current roller hockey puck designs.

The roller hockey puck 10 of the present invention provides for increased stick handling characteristics. Since the roller hockey puck 10 of the present invention is generally the same size and weight of a conventional ice hockey puck, it will perform similar to that of an ice hockey puck. Through the use of the TEFLON(TM) impregnated ACETAL(TM) runners 34 and 36, the surface area in contact with the playing surface is decreased significantly. This will allow the TEFLON(TM) lubricated runner to slide easily along uneven or dimpled surfaces.

The nature of the outer shell 12 and the truncated sphere core 18 will serve as a centrifuge which provides additional stability in flight. This centrifuge action is created by the use of the central core 18 as directing air flow over the transition section 20. This re-directs the associated spin forces so as to focus on the center of the roller hockey puck 10.

The use of the respective runners 34 and 36 will reduce typical wear which will occur on traditional roller hockey pucks. The material composition of the roller hockey puck will reduce bounce and roll which is associated with elevated outdoor temperatures.

The use of the elliptical holes 22 also provides for impact bounce reduction. The trajectory with which the roller hockey puck 10 impacts the rink board usually provides unpredictable reactionary results. The series of elliptical holes 22, which are placed at radial angles off the center 30 of the central core 18, provides a type of shock absorber effect that eliminates the unpredictable reactionary forces that occur in other pucks. Through finite element analysis, it is possible to predict, with 95% accuracy, the exit trajectory of the roller hockey puck 10.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A roller hockey puck comprising:

an outer shell of annular configuration having a top planar surface and a bottom planar surface;

a central core positioned centrally interiorly of said outer shell, said central core having a truncated spherical configuration with a central axis aligned with a central axis of said outer shell; and a transition section extending from said central core to said outer shell, said transition section having a plurality of elliptical holes formed therein.

2. The puck of claim 1, said transition section having a top surface formed inwardly of said top planar surface of said outer shell, said transition section having a bottom surface formed inwardly of said bottom planar surface of said outer shell.

3. The puck of claim 1, said plurality of elliptical holes being uniformly spaced around said central core.

4. The puck of claim 1, each of said plurality of elliptical holes having a centerline longitudinally therethrough, said centerline extends at an acute angle relative to a radius extending from a center point of said central core.

5. The puck of claim 4, said centerline extending on a line tangent to an outer surface of said central core.

6. The puck of claim 1, said central core having a top surface coplanar with said top planar surface of said outer shell, said central core having a bottom surface coplanar with said bottom planar surface of said outer shell.

7. The puck of claim 1, said outer shall having a cylindrically-shaped outer surface.

8. The puck of claim 1, said outer shell having a plurality of through bores extending from said top planar surface to said bottom planar surface, said plurality of through bores being uniformly radially spaced from one another around said outer shell.

9. The puck of claim 8, further comprising:

a plurality of runners respectively received by said plurality of through bores, each of said plurality of runners having a top surface extending outwardly of said top planar surface, each of said plurality of runners having a bottom surface extending outwardly of said bottom planar surface.

10. The puck of claim 1, said outer shell, said central core and said transition section being formed of high density polyethylene material adapted to maintain a constant durometer between 30 degrees and 150 degrees Fahrenheit.

11. A roller hockey puck comprising:

an outer shell of annular configuration having a top planar surface and a bottom planar surface;

a central core positioned centrally interiorly of said outer shell, said central core having a truncated spherical configuration with having a central axis aligned with a central axis of said outer shell, said central core having a top surface being coplanar with said top planar surface of said outer shell, said central core having a bottom surface being coplanar with said bottom planar surface of said outer shell; and a transition section extending from said central core to said outer shell, said transition section having a top surface formed inwardly of said top planar surface of said outer shell, said transition section having a bottom surface formed inwardly of said bottom planar surface of said outer shell.

12. The puck of claim 11, said transition section having a plurality of elliptical holes formed therein.

13. The puck of claim 12, said plurality of elliptical holes being uniformly spaced around said central core.

14. The puck of claim 13, each of said plurality of elliptical holes having a centerline extending longitudinally therethrough, said centerline extending at an acute angle relative to a radius extending from a center point of said central core.

15. The puck of claim 14, said centerline extending on a line tangent to an outer surface of said central core.

16. The puck of claim 11, said outer shell having a plurality of through bores extending from said top planar surface to said bottom planar surface, said plurality of through bores being uniformly radially spaced from one another around said outer shell, said puck further comprising:

a plurality of runners respectively received by said plurality of through bores, each of said plurality of runners having a top surface extending outwardly of said top planar surface, each of said plurality of runners having a bottom surface extending outwardly of said bottom planar surface.

17. A roller hockey puck comprising:

an outer shell of annular configuration having a top planar surface and a bottom planar surface, said outer shell having a plurality of through bores extending from said top planar surface to said bottom planar surface, said plurality of through bores being evenly spaced around said outer shell, said outer shell having a cylindrical outer surface;

a central core positioned centrally interiorly of said outer shell, said central core having a truncated spherical configuration with a central axis aligned with a central axis of said outer shell, said central core having a top surface coplanar with said top planar surface of said outer shell, said central core having a bottom surface coplanar with said bottom planar surface of said outer shell;

a transition section extending from said central core to said outer shell; and a plurality of runners respectively received by said plurality of through bores, each of said plurality of runners having a top surface extending outwardly of said top planar surface, each of said plurality of runners having a bottom surface extending outwardly of said bottom surface.

18. The puck of claim 17, said transition section having a plurality of elliptical holes therein, said transition section having a top surface formed inwardly of said top planar surface of said outer shell, said transition section having a bottom surface formed inwardly of said bottom planar surface of said outer shell, said plurality of elliptical holes being uniformly spaced around said central core.

* * * * *